United States Patent [19]

Nelson

[11] 4,355,745

[45] Oct. 26, 1982

[54] SHOE HORN FOR HANDICAPPED PERSONS

[76] Inventor: Marie A. Nelson, 600 E. 8 St. #416, Kansas City, Mo. 64106

[21] Appl. No.: 172,272

[22] Filed: Jul. 25, 1980

[51] Int. Cl.[3] ..... A47J 51/02

[52] U.S. Cl. ..... 223/118

[58] Field of Search ..... 223/118, 119

[56] References Cited

U.S. PATENT DOCUMENTS

| | | | |
|---|---|---|---|
| 732,854 | 7/1903 | Hepner | 223/118 |
| 1,424,030 | 7/1922 | Peck | 223/118 |
| 2,939,618 | 6/1960 | Mangels | 223/118 X |
| 3,410,463 | 11/1968 | Carlos | 223/119 |
| 3,591,226 | 7/1971 | Elmore | 223/119 |

FOREIGN PATENT DOCUMENTS

| | | | |
|---|---|---|---|
| 239783 | 1/1911 | Fed. Rep. of Germany | 223/118 |
| 814426 | 6/1959 | United Kingdom | 223/118 |

*Primary Examiner*—Louis Rimrodt

*Attorney, Agent, or Firm*—Emil G. Anderson

[57] ABSTRACT

This invention relates to a specially constructed shoe horn for persons having limited body bending movements. The device has an elongated handle means enabling a person to put on footwear without substantial bending at the waist, hips or knees.

1 Claim, 4 Drawing Figures

SHOE HORN FOR HANDICAPPED PERSONS

My invention relates to a new and improved type of shoe horn. An object of this invention is to provide a shoe horn designed to aid persons with certain limited body or arm movements to put on footwear.

Persons with certain limitations find it difficult, if not impossible, to sufficiently bend their bodies at the waist, hips or knees so as to reach down to put on their shoes using the ordinary shoe horn. This device is useful for persons troubled with any one or all of the mentioned physical limitations.

The main object of this invention is therefore to provide an elongated handle attached to an elongated shoe horn to enable the person with limited body movements to manipulate the shoe horn so as to guide the foot into the shoe.

Other objects and advantages of my invention will become apparent in view of the specifications and drawings and from the appended claims.

Figure 1:
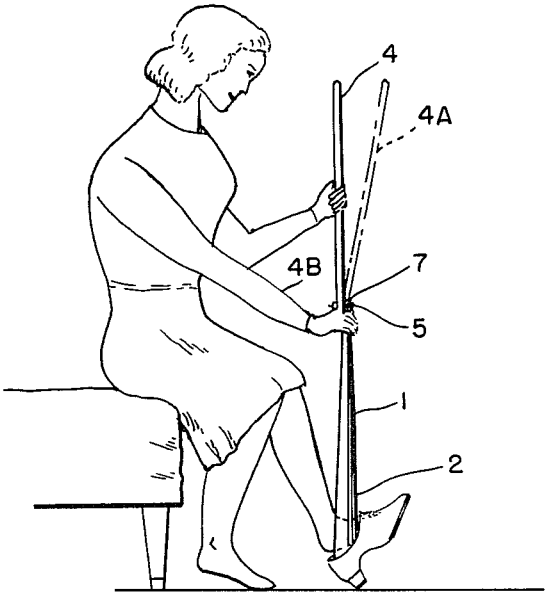
FIG. 1 is a view of the first modification of the device, as it appears in the first stage of the manipulation of the device in putting on footwear.
Figure 2:
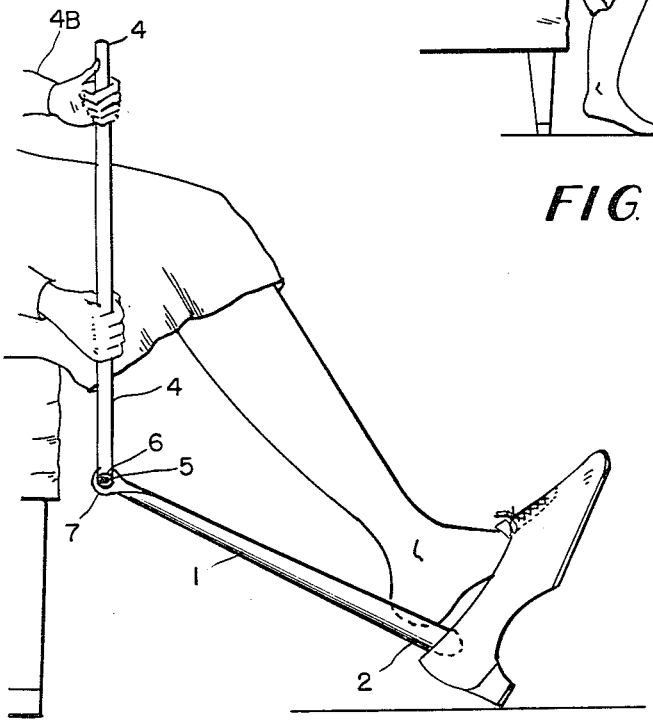
FIG. 2 shows a different view of the device (at right angles to that of FIG. 1) at a later stage of the manipulation of the device.
Figure 3:
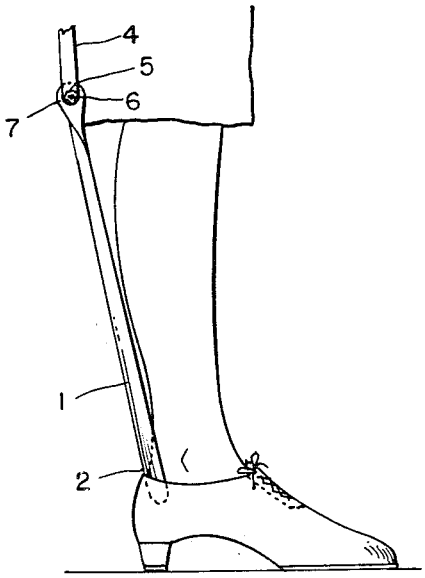
FIG. 3 shows the device after the foot has been guided into the footwear.

As stated above FIGS. 1–3 illustrate various stages of the manipulation of the device in putting on footwear. In the modifications shown in FIGS. 1–3, the device consists of an elongated shoe horn member 1 within the range of 6–24 inches in length, the lower end 2 thereof being curved into a partial cylindrical shape in cross section as is well known in the shoe horn art. The upper end of the shoe horn 1 has a flat web portion 7 formed to extend in the plane of the axis of the cylindrical shaped portion. The web portion 7 is apertured at 6 to receive a connecting pin or bolt 5, for pivotal connection with the lower end of handle element 4. The handle part 4 in this form is made of rigid, lightweight material preferably rectangular in cross section and within the range of 20–25 inches in length. The handle may be round in cross-section, if desired. The lower end of handle 4 is apertured to receive connecting pin 5. It is preferable that a loose connection be made between members 1 and 4 to permit the handle to tilt slightly in the plane of the pin as shown in dotted lines at 4A.

The method of use by a physically handicapped person as illustrated in FIGS. 1–3, is as follows:

1. The foot is slipped into the (tied) shoe as far as it will go.

2. Gripping the handle member as shown at 4B, the shoe horn is lowered so that end 2 enters into the shoe with the concave surface contacting the foot and preferably on the inner side of the foot, see FIG. 1.

3. Permitting the handle 4 to slide downwardly to thereby cause the shoe horn to attain nearly a horizontal position, see FIG. 2. As the upper end of the shoe horn is lowered the handle is manipulated (requiring some swinging or lateral and rotary motion) so as to bring the shoe horn end 2 towards and under the heel, while shoe horn end 2 still is partially in the shoe, see FIG. 2. (A handle with rectangular cross-section facilitates gripping of the handle for rotation thereof.)

4. When the shoe horn has been positioned under the heel the handle 4 is pulled upwardly thus starting to force the heel into the shoe. Upon continued upward movement of the handle, the heel is eased into the shoe, after which the shoe horn is retracted, see FIG. 3.

As is evident the elongated handle 4 permits the shoe horn to be lowered under the heel without the person having to bend his body either at the waist, hips or knees. It takes some patience to properly maneuver the device. However, with little practice, the device can be manipulated to guide the foot into the shoe with ease, and has been found very useful for persons with limited bending movement.

The advantages of using a relatively long shoe horn, i.e., 24 inches, are (1) easier manipulation of the shoe horn to get it under the heel, (2) provides considerable leverage thus requiring a relatively small upward force in guiding the heel into the shoe, (3) the handle member 4 may be either rigid or flexible. In using the relatively long shoe horn the foot may be placed sufficiently spaced from the user's chair or bed to prevent the latter from interfering with the required swinging movement of the shoe horn. It should be noted that the exact length of the handle 4 may be varied depending upon the stature of the person using the device.

Figure 4:
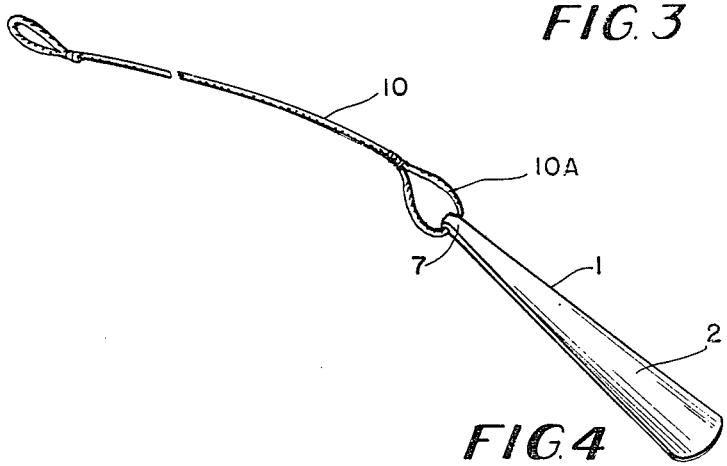
FIG. 4 shows a modified handle element

The handle member 10 in the modifications of FIG. 4 is made of flexible resilient material such as cord material and of a length approximately within the 16–24 inch range. The handle material has sufficient stiffness so that the shoe horn can be guided into the shoe. The lower end of handle member 10 is formed in a loop 10A for connection to shoe horn 2 as shown in FIG. 5.

The mode of operation of the form of FIG. 4 is the same as described above in connection with the form of FIG. 1.

While the above description and illustrated drawings disclose the preferred embodiments of the invention it is to be understood that minor changes may be resorted to in commercial adaptation of the invention without departing from the scope of the invention as hereinafter claimed.

I claim:

1. A method of manipulating a shoe horn device so as to enable a person, with little or no bending movement of the body at the waist, hips or knees, to put on (laced up or elastic top) shoes, wherein the shoe horn device comprises an elongated shoe horn of the order of 20 to 24 inches in length having a curved portion at one end for engaging the heel and an elongated handle device of the order of 20–25 inches in length pivoted at one end to the other end of the shoe horn, said method consisting of the following steps (1) slipping the foot into the shoe as far as it will go while the person is in a seated position (2) gripping the handle and holding it and the shoe horn in a vertical position (3) manipulating the handle so that the end of the shoe horn enters the shoe with the concave portion contacting the foot on the inner side of the foot, (4) letting the gripped handle slide downwardly to thereby cause the shoe horn to attain substantially a horizontal position while at the same time slightly moving the handle laterally to maneuver the shoe horn to bring its curved end toward and under the heel while the shoe horn end is still partially in the shoe (5) with the shoe horn end under the heel lifting the handle upwardly thus forcing the heel (and the foot) completely into the shoe and (6) withdrawing the shoe horn from the shoe.

* * * * *